US008480827B2

(12) United States Patent
Harvey et al.

(10) Patent No.: US 8,480,827 B2
(45) Date of Patent: Jul. 9, 2013

(54) PROCESS OF RESURFACING A SUBSTRATE WITH AN ENGINEERED QUARTZ MATERIAL

(75) Inventors: Sean Christopher Harvey, Orlando, FL (US); John Willis Hassel, Pembroke Pines, FL (US)

(73) Assignee: Sean Harvey, Orlando, FL (US)

( * ) Notice: Subject to any disclaimer, the term of this patent is extended or adjusted under 35 U.S.C. 154(b) by 0 days.

(21) Appl. No.: 13/136,650

(22) Filed: Aug. 8, 2011

(65) Prior Publication Data

US 2013/0037197 A1 Feb. 14, 2013

(51) Int. Cl.

| | |
|---|---|
| ***E04F 13/02*** | (2006.01) |
| ***E04F 13/14*** | (2006.01) |
| ***B29C 65/52*** | (2006.01) |
| ***B32B 37/16*** | (2006.01) |
| ***B32B 37/18*** | (2006.01) |
| ***B32B 38/10*** | (2006.01) |

(52) U.S. Cl.

USPC ..... 156/71; 156/258; 156/264; 156/267

(58) Field of Classification Search

USPC ..... 156/71, 250, 256, 258, 264, 267

See application file for complete search history.

(56) References Cited

U.S. PATENT DOCUMENTS

| | | | | |
|---|---|---|---|---|
| 7,055,787 | B2 * | 6/2006 | Cross | 248/226.11 |
| 7,226,517 | B2 * | 6/2007 | Lane | 156/71 |
| 2003/0124269 | A1 * | 7/2003 | Servi | 428/15 |
| 2007/0244222 | A1 * | 10/2007 | Ghahary et al. | 523/171 |

* cited by examiner

*Primary Examiner* — Sing P Chan

(57) ABSTRACT

The invention relates to a method of resurfacing a substrate with an engineered quartz material comprised of 93% ground up quartz and recycled post-industrial or post-consumer materials mixed with 7% pigments and binders with a thickness ranged from 5-19 mm. The method includes cutting a first piece with an overhang and an edge piece of the engineered quartz from the slab material, attaching the edge piece to the overhang to form a seam at 90-degrees and attaching 1.5" wide fiberglass cloth strips to the inside edge to reinforce the seam to form a resurfacing assembly and adhesively attaching the resurfacing assembly to the substrate.

4 Claims, 5 Drawing Sheets

PROCESS OF RESURFACING A SUBSTRATE WITH AN ENGINEERED QUARTZ MATERIAL

BACKGROUND OF INVENTION

The invention is based on improving concerns with materials of natural stone to be used for resurfacing a substrate/countertop that range between 5-19 mm thick.

U.S. patent application Ser. No. 11/749,298 Published Sep. 13, 2007—"Method of Resurfacing a Substrate—Discloses how the process of fabricating natural stone this thin has proved to be difficult due to full slabs breaking or developing unacceptable cracking."

SUMMARY OF THE INVENTION

The improved process of resurfacing a substrate with engineered quartz results in resurfacing a substrate that is more advantageous for countertop and shower wall applications than natural stone with a similar thickness. A slab of engineered quartz for resurfacing ranges from 5-19 millimeters. The prior process of using natural stone required additional reinforcement to support natural cut below 19 millimeters. Adversely, the improved process of using engineered quartz is bound with binders within the slab to further reinforce the integrity. The binders within the engineered quartz result in a flexural strength four times greater than natural stone of similar thickness. The prior process of transporting, fabricating and installing natural stone of similar thickness can prove to be difficult due to full slabs and fabricated countertops breaking and/or developing unacceptable cracking. The flexural strength of engineered quartz enables the slab to be less susceptible to cracking during transporting, fabricating and installing.

The inventors of the present invention have determined that the improved process of resurfacing a substrate with engineered quartz instead of natural stone allow for improved efficiencies in time, availability of slabs, abundant colors, transporting, fabricating and installing. The improved process of fabricating an attached precut straight edge at a 90-degree seam versus the prior 45-degree miter results in additional edge profiles. The improved process will result in additional edge profiles for the customer who was once limited with only two edge profiles with the natural stone of similar thickness. When attaching the edge at 90-degrees, the seam is now lower and less visible. When the edge is attached, the seam is not as visible as prior methods when the seam was attached at a 45-degree miter angle at the top. The availability of natural stone of similar thickness is limited due to the degree of difficulty to cut a natural stone less than 19 millimeters thick and the additional time to reinforce the backside. There are numerous networks of dedicated distributors of engineered quartz products similar in thickness. The prior method using natural stone in the similar thickness has limited availability of colors while similar sized-engineered quartz has hundreds of color choices.

In this respect, the improved process using engineered quartz from a similar thickness for resurfacing compared to the same thickness for natural stone results in minimal cracking and damage during transporting, fabricating and installing process. The improved process of attaching a precut straight edge at a 90-degree seam results in additional edge choices from the prior 45-degree seam attachment like the ogee and bevel profiles with less a less visible seam that the prior method could not achieve. A model structure allows for using engineered quartz slabs that range from 5-19 millimeters in thickness without a required reinforced backing from the supplier. It will be acknowledged that the improved process of using engineered quartz results in four time the durability of natural stone of similar thickness, abundant supply/availability of color choices, additional edge profile designs and improved time savings. The aforementioned method of using engineered quartz may be more advantageous to use in a resurfacing application with accordance to the aspects of the invention.

DETAILED DESCRIPTION OF THE INVENTION

The invention provides an improved process for resurfacing a substrate with a more durable material of engineered quartz and attaching the seam at a 90-degree angle to achieve more edge profiles with a less visible seam. Aspects of the improved invention may be used for resurfacing various surface or used with other substrates. Slabs of engineered quartz ranging in thickness from 5-19 millimeters would accommodate the application used for this improved method. The person making the templates may make notes on the templates. These notes can act as guidance to provide instructions to other persons involved in the resurfacing process. Additional notes written on the template can include acceptable margins of tolerance, additional width or length, center of sink line for accurate sink cut out, corner and edge profile choice all to ensure a custom and accurate template to fit properly when fabricating and installing.

Figure 1:
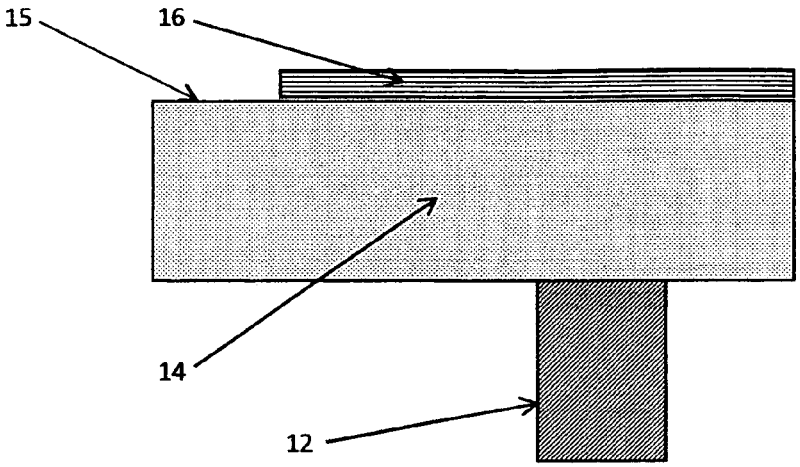
FIG. 1 is a side view of a substrate with the templating strip used in accordance with aspects of the invention.

FIG. 1 Illustrates a side view of a substrate 15 and cabinet frame 12. The template strip 16 creates the outside dimension on the surface 15 to create outline for resurface piece. Writing notes on the template strip 16 to indicate the amount of overhang needed. The overhang will range between 5-19 mm to exceed the edge of substrate 14 for the edge piece to be attached.

Figure 2:
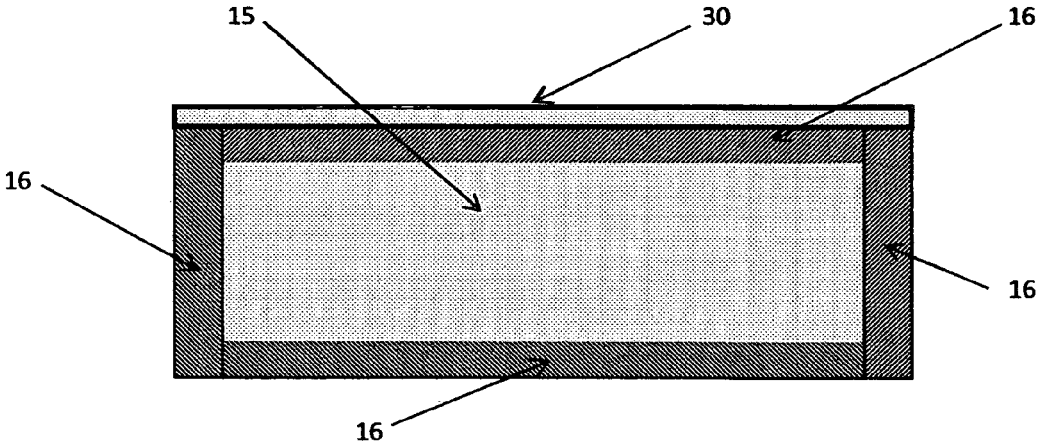
FIG. 2 is a plan view of a substrate with templating strips laid out on a material for surfacing a substrate.

FIG. 2 Illustrates a top view of template strips 16 forming an outside dimension of a substrate 15. The template strips should be snug against all backsplash 30 or walls so the outside dimension of the template can be glued together to form an outline of the substrate 15. Writing notes on the template 16 to indicate the thickness of a back splash 30 to add to the overall surface measurement. If there is a wall then the template will be place snug to the wall.

Figure 3:
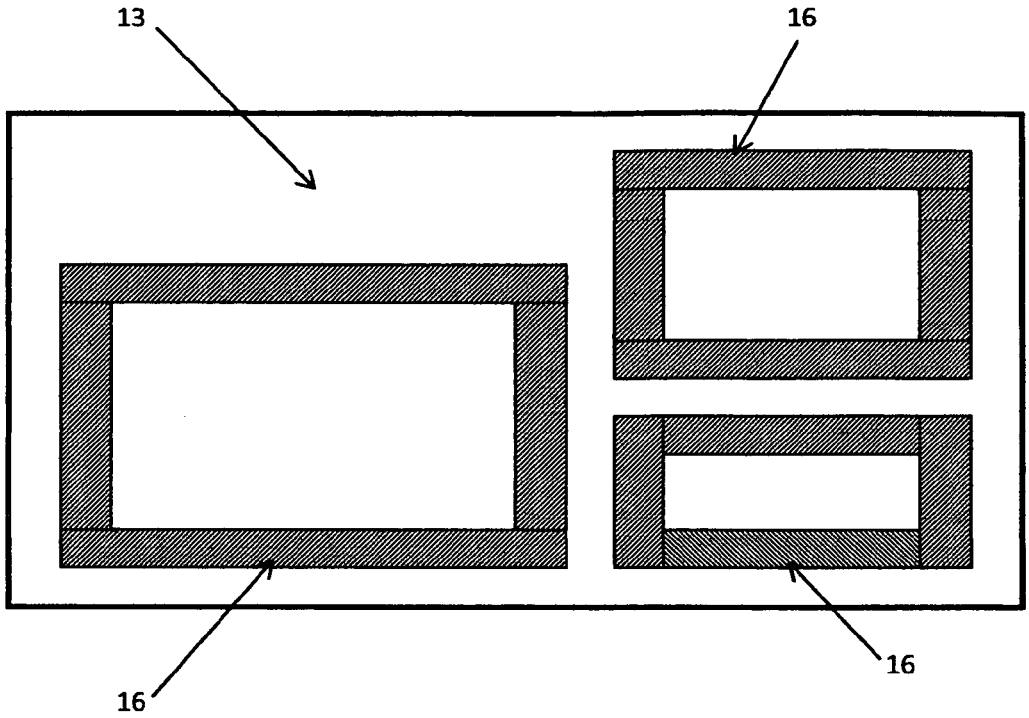
FIG. 3 is an overhead view of completed templates laid out on a material for surfacing substrate.

FIG. 3 Illustrates a slab of engineered quartz ranging in thickness of 5-19 mm. The template strip 16 that has formed an outline of the substrate 15 is placed on the slab 13 to map out the pieces to cut. To secure the template strip 16 to the slab 14 so it does not move during cutting, tape down the inside edge of the template strip 16. Written notes on the template strip 16 to include edge location, sink center line location, wall location, backsplash thickness, cook top location, fridge location and where a seam might be located for use during fabrication and installation.

Figure 4:
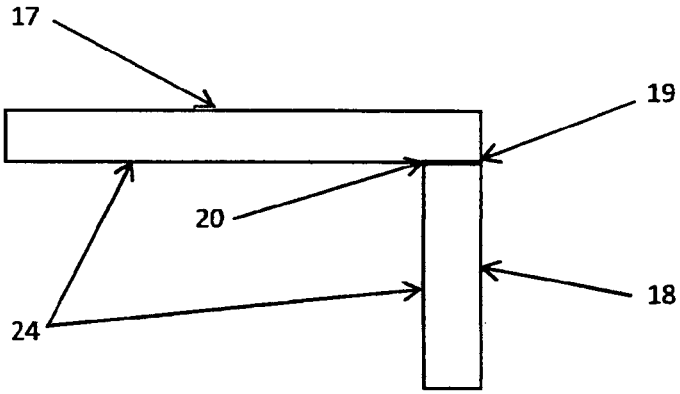
FIG. 4 is a side view of a straight edge and surface piece adjoined at a 90-degree angle in accordance with aspects of the invention.

FIG. 4 Illustrates a side view of a surface top piece 17 that has been cut from the engineered quartz slab 13 to form a 90-degree angle. The front seam 19 is place at a 90-degree making visibility less noticeable. Prior methods attached the seam with a 45-degree miter that made the seam more visible on the top. Epoxy 20 is used to form a bond between the edge piece 18 to the surface top piece 17. Mix epoxy 20 and harder to apply a layer of glue to the bottom side of the surface piece 24.

Figure 5:
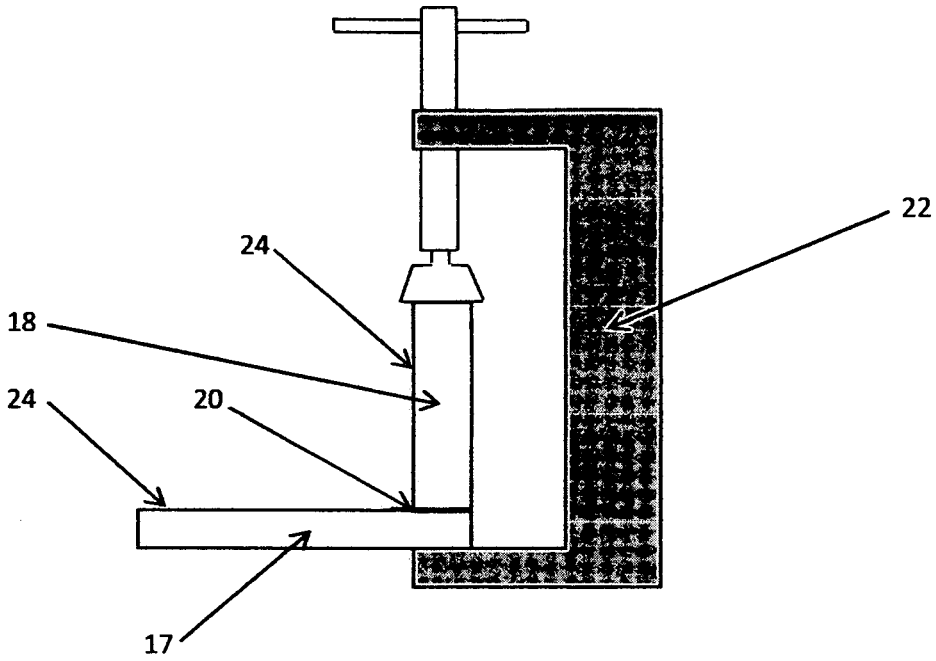
FIG. 5 is a side view of an edge band and surface piece of material to be adjoined with a C-Clamp in accordance with aspects of the invention.

FIG. 5 Illustrates a side view of surface top piece 17 and edge piece 18 joined with a C-Clamp 22. C-Clamp 22 provides a tight fit between surface top piece 17 and edge piece 18 while keeping a 90-degree position in pose for the epoxy 20 to dry. Removes excess glue on the backside where inside surface top piece 24 and inside edge piece are joined to ensure a level fit when the overlay is installed on the substrate.

Figure 6:
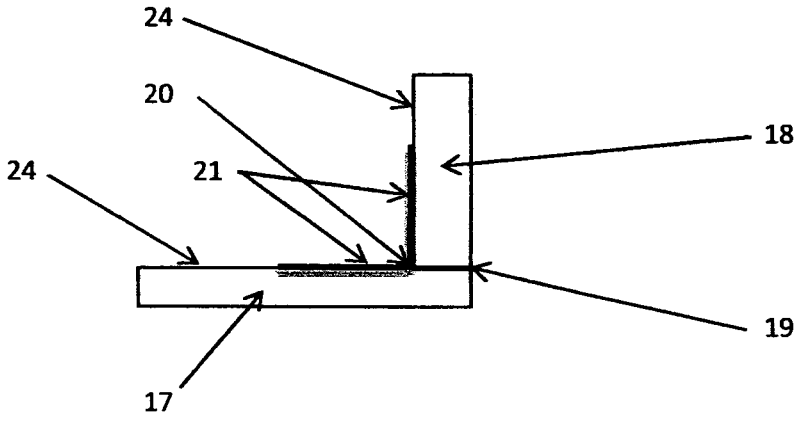
FIG. 6 is a side view of the edge piece and surface piece with a fiberglass cloth strips to reinforce the attached pieces.

FIG. 6 Illustrates a side view of the surface top piece 17 and edge piece 18 joined together with epoxy 20 that has been cured. To support the inside angle an appropriate material to use is 1.5" wide fiberglass cloth strip 21 with liquid resin mixed with hardener. Mix together the resin with harder in a cup and apply the resin with a paint brush on the fiberglass cloth strip 21 making sure to saturate the fiberglass cloth strip 21 so it adheres to the inside surface top piece 24 and inside edge piece 24 to create a 90-degree bond between the backside of the surface top piece 24 and backside edge piece 24. Grinding the dried fiberglass resin tape 21 will assure a smooth fit when installing over the substrate.

Figure 7:
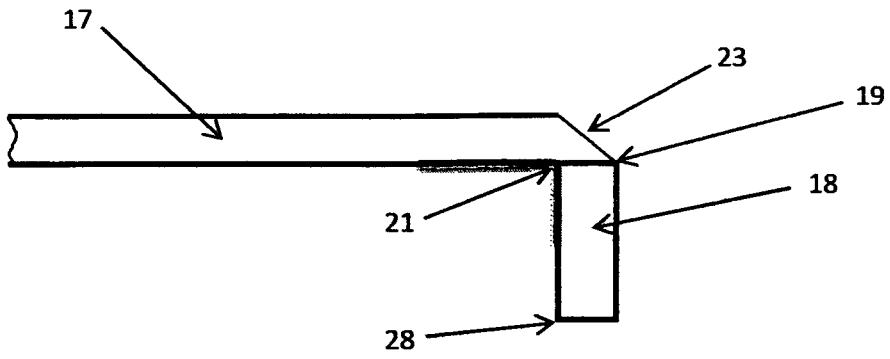
FIG. 7 is a side view of the edge attachment with a bevel edge profile.

FIG. 7 Illustrates a side view of a bevel edge profile. The bevel edge is created by cutting a slant at a 45-degree angle 23. The seam 19 is less visible with the bevel angle 23 slanting into the seam 19. This is achieved by attaching the edge 18 to the surface piece 17 at a 90-degree angle.

Figure 8:
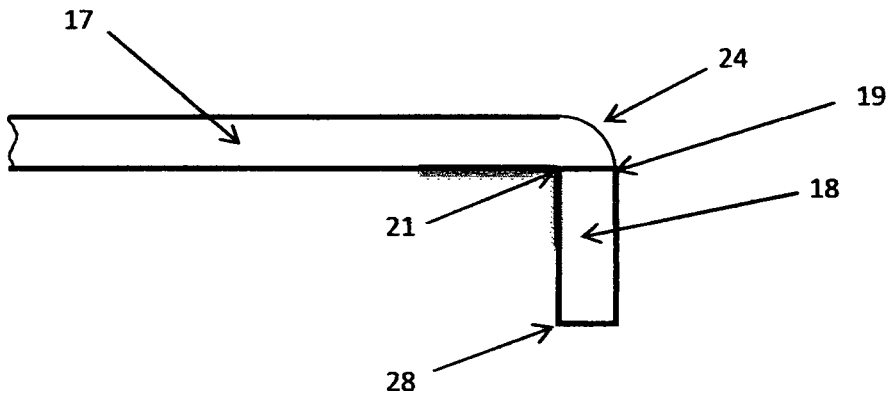
FIG. 8 is a side view of the edge attachment with a round over edge profile.

FIG. 8 Illustrates a side view of a half inch round over edge profile 24. The half-inch round over 24 is created by grinding a curve then polishing the curve to create a round over edge profile 24. The seam 19 is less visible with the half inch round over 24 curved into the seam 19. The is achieved by attaching the edge 18 to the surface piece 17 at a 90-degree angle.

Figure 9:
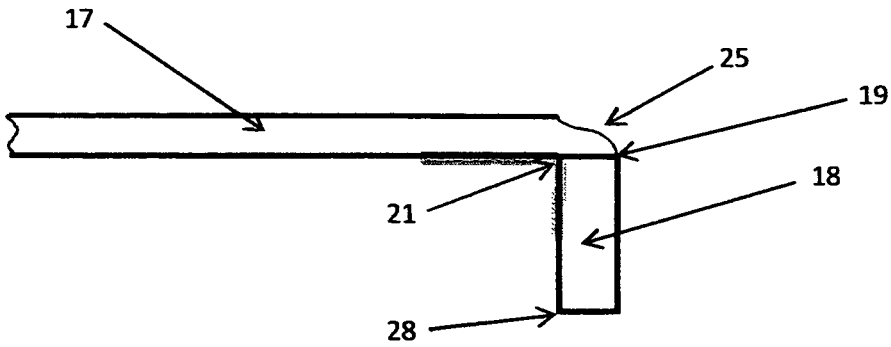
FIG. 9 is a side view of the edge attachment with an ogee edge profile.

FIG. 9 Illustrates a side view of an ogee edge profile 25. The ogee edge requires a router bit to achieve the inward groove. Once the ogee is routed into the edge 25 you can now polish to finish. The ogee edge 25 is curved into the seam 19 resulting in a less visible. By attaching the edge 18 to the surface piece 17 at 90-degree angle we achieve a less visible seam.

Figure 10:
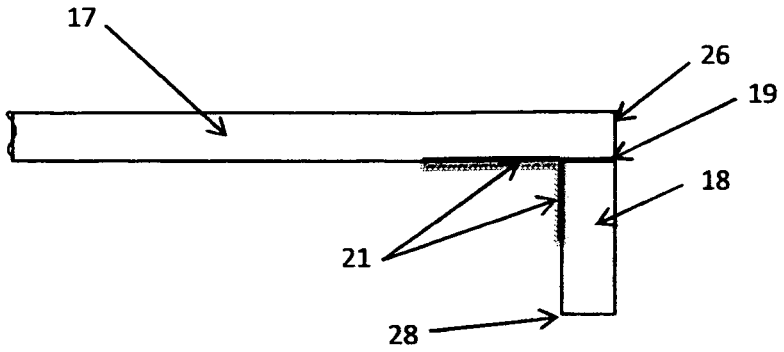
FIG. 10 is a side view of the edge attachment with a straight edge profile.

FIG. 10 Illustrates a side view of a straight edge profile 26. The straight edge profile 26 does not create a profile into the seam 19. For a less visible seam, the bevel edge profile 234, round over profile 24 and ogee edge profile 25 are recommended.

We claim:

1. A method of resurfacing a substrate with an engineered quartz, the method comprising:

applying a plurality of template strips to a top surface of said substrate to form a template sized to cut a first piece of said engineered quartz for resurfacing said top surface of said substrate;

determining an amount for an overhang of said first piece of said engineered quartz material that will extend beyond a top edge of said substrate;

noting on said template said amount for said overhang needed to extend past said top edge of said substrate;

removing said template from said top surface of said substrate;

providing a slab of said engineered quartz comprising 93% ground up quartz, post-industrial or consumer material, and 7% pigments and binders in a thickness ranged from 5-19 mm;

overlaying said template on a top surface of said slab of said engineered quartz;

cutting said first piece of said engineered quartz based on outside dimension of said template and said overhang;

cutting an edge piece of said engineered quartz sized to resurface an edge of said substrate;

applying an epoxy adhesive between a lower surface of said overhang and a top edge of said edge piece to bond said edge piece to said overhang to form a resurface assembly;

wherein said top edge of said edge piece joined to said lower surface of said overhang to form a 90° degrees seam;

applying a fiberglass cloth to an inside edge of said first piece of engineered quartz and said edge piece;

cutting an edge profile into a top surface edge of said overhang to form a profiled resurface assembly;

wherein said edge profile is selected from a group consisting of bevel, half inch round, and ogee; and adhesively jointing said profiled resurfacing assembly to said top surface and said edge of said substrate.

2. The method of claim 1 further comprising:

using a C-clamp to hold said edge piece to said overhang.

3. The method of claim 1 further comprising:

applying a liquid resin over said fiberglass cloth.

4. The method of claim 1 further comprising:

using two type of epoxies to adhesively jointing said resurface assembly and said substrate.

* * * * *